US005813296A

United States Patent [19]

Hoff et al.

[11] Patent Number: 5,813,296

[45] Date of Patent: Sep. 29, 1998

[54] QUICK RELEASE SOCKET MECHANISM

[75] Inventors: Jeffrey H. Hoff, Kenosha; Frank Mikic, deceased, late of Lake Geneva; Mark Eberhage, legal representative, Greenfield, all of Wis.

[73] Assignee: Snap-On Technologies, Inc., Lincolnshire, Ill.

[21] Appl. No.: 721,227

[22] Filed: Sep. 26, 1996

[51] Int. Cl.[6] ..... B25B 23/16

[52] U.S. Cl. ..... 81/177.85; 81/124.4; 81/DIG. 11

[58] Field of Search ..... 81/177.85, 124.4, 81/DIG. 11; 403/325, 328, 356, 357, 358, 361, 329

[56] References Cited

U.S. PATENT DOCUMENTS

| | | | |
|---|---|---|---|
| 1,864,466 | 9/1932 | Peterson . | |
| 2,913,263 | 11/1959 | Zajac | 403/325 |
| 3,208,318 | 9/1965 | Roberts . | |
| 3,682,506 | 8/1972 | Bruyere et al. | 403/328 |
| 4,187,747 | 2/1980 | Pawlaw . | |
| 4,245,528 | 1/1981 | Hugh et al. . | |
| 4,297,924 | 11/1981 | Stephens . | |
| 4,367,663 | 1/1983 | Merics | 81/177 |
| 4,399,722 | 8/1983 | Sardo, Jr. . | |
| 4,453,449 | 6/1984 | Hollmann | 403/328 |
| 4,480,511 | 11/1984 | Nickipuck . | |
| 4,502,365 | 3/1985 | Hacker . | |
| 4,537,100 | 8/1985 | Palm . | |
| 4,614,457 | 9/1986 | Sammon . | |
| 4,647,089 | 3/1987 | Zangrando | 403/325 |
| 4,671,718 | 6/1987 | Eakin | 81/177.85 |
| 4,733,584 | 3/1988 | Karge . | |
| 4,762,033 | 8/1988 | Chow . | |
| 4,768,405 | 9/1988 | Nickipuck . | |
| 4,770,073 | 9/1988 | Palm . | |
| 4,781,085 | 11/1988 | Fox, III . | |
| 4,817,476 | 4/1989 | Karge . | |
| 4,865,485 | 9/1989 | Finnefrock, Sr. . | |
| 4,905,549 | 3/1990 | Nickipuck . | |
| 4,938,107 | 7/1990 | Nickipuck . | |
| 4,962,682 | 10/1990 | Rose et al. . | |
| 5,090,275 | 2/1992 | McCann . | |
| 5,289,745 | 3/1994 | Beardsley . | |
| 5,291,809 | 3/1994 | Fox, III et al. . | |
| 5,333,523 | 8/1994 | Palm . | |
| 5,390,571 | 2/1995 | Fox, III et al. . | |
| 5,433,548 | 7/1995 | Roberts et al. . | |

*Primary Examiner*—James G. Smith
*Assistant Examiner*—Lee Wilson
*Attorney, Agent, or Firm*—Emrich & Dithmar

[57] ABSTRACT

A socket drive tool includes an elongated shaft having a coupling structure for coupling to a socket. The coupling structure includes a detent ball disposed in a detent recess and moveable between retaining and releasing positions relative to the socket. The shaft has a cavity therein communicating with the detent recess. A tubular sleeve having a sleeve cam surface is disposed coaxially about the shaft for movement between a retaining condition and a releasing condition. A rod is moveable axially between retaining and releasing conditions, being spring-biased to the latter. The rod has within the cavity a first cam surface engageable with the detent ball and a second cam surface engageable with a transfer ball which is, in turn, engageable with the sleeve cam surface. When the sleeve is in the retaining condition, the sleeve cam surface causes the transfer ball and rod to hold the detent ball in its retaining position, and when the sleeve is in the releasing condition it causes the transfer ball and the rod to permit movement of the detent ball to its releasing position.

13 Claims, 2 Drawing Sheets

QUICK RELEASE SOCKET MECHANISM

BACKGROUND OF THE INVENTION

1. Field of the Invention

This invention relates to hand tools, in particular to socket wrenches and drive accessories therefor.

2. Description of the Prior Art

There have been various acceptable socket release mechanisms on socket drive tools, such as ratchets, breaker bars and extensions and adaptors therefor, for removably retaining sockets thereon. Such mechanisms are typically manually operable between releasing and retaining conditions relative to the socket.

Many of these mechanisms are complex and costly to manufacture. Others of these mechanisms do not adequately retain the socket on the drive tool, thereby allowing the socket to be unintentionally removed (sometimes in use) from the drive tool, which can be inconvenient and even dangerous.

SUMMARY OF THE INVENTION

It is a general object of the invention to provide a socket drive tool with an improved coupling mechanism which avoids the disadvantages of prior drive tools while affording additional and structural advantages.

An important feature of the invention is the provision of a drive tool of the type set forth which is of relatively simple and economical construction.

Another feature of the invention is the provision of a drive tool of the type set forth which will strongly and safely couple a socket thereto and allow a quick release therefrom.

These and other features of the invention are attained by providing a socket drive tool for use with a socket. The drive tool includes an elongated shaft having a coupling structure for coupling to a socket. The coupling structure includes a detent recess and a detent member disposed in the recess and moveable between retaining and releasing positions relative to the socket. The shaft has a cavity therein communicating with the detent recess. The drive tool also includes a tubular sleeve disposed about the shaft and which has a sleeve cam surface. The tubular sleeve is moveable between a retaining condition and a releasing condition. The drive tool also includes a linking structure disposed in and moveable within the cavity and have a first cam surface engageable with the detent member and a second cam surface engageable with the sleeve cam surface, wherein when the tubular sleeve is in the retaining condition, the sleeve cam surface causes the linking structure to hold the detent member in its retaining condition, and wherein when the tubular sleeve is in the releasing condition it causes the linking structure to permit movement of the detent member to its releasing position.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figures 1, 2, 3:
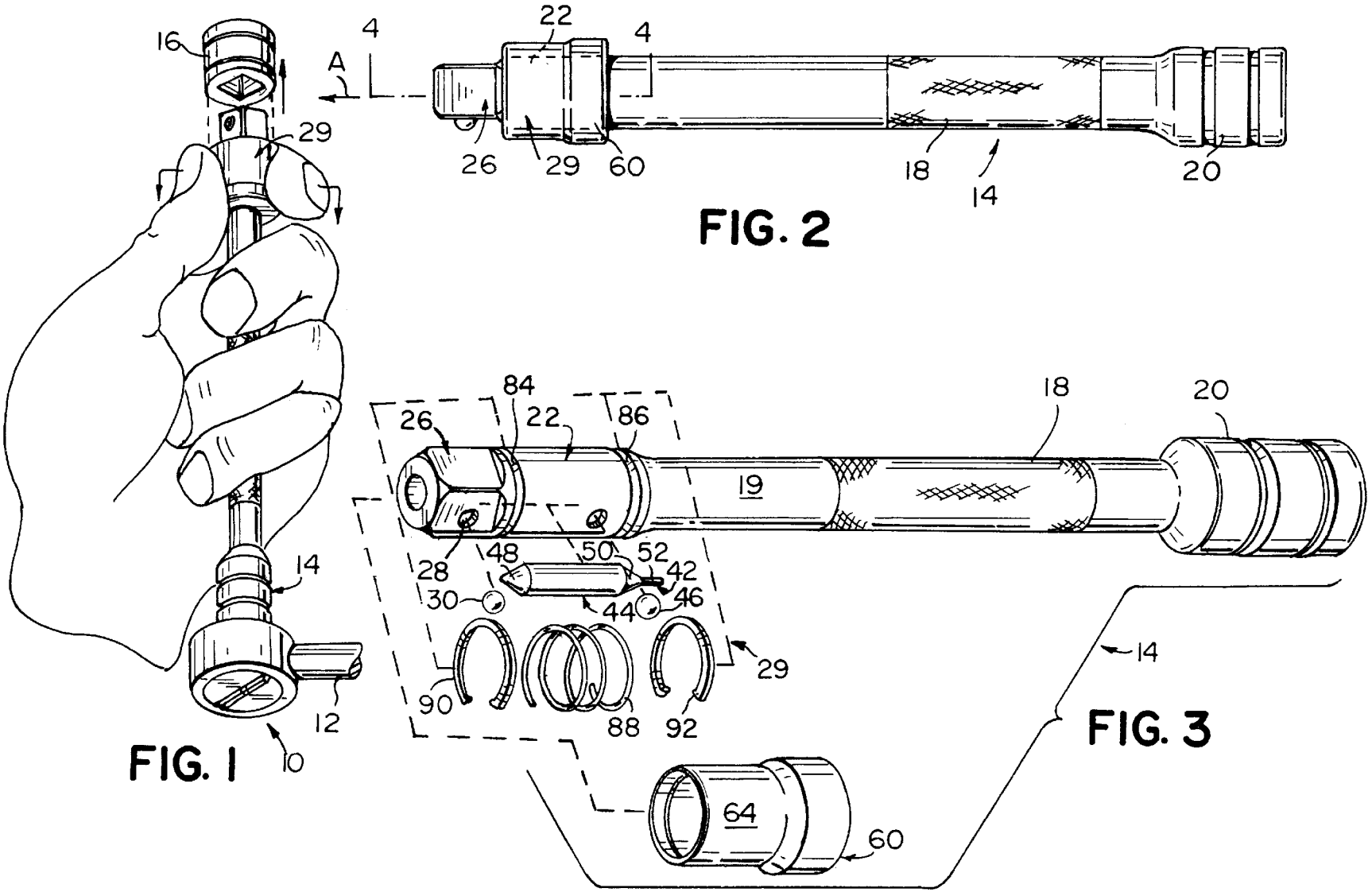
FIG. 1 is a fragmentary perspective view of a socket wrench including the socket drive tool of the present invention held by a user.
FIG. 2 is an enlarged, side elevational view of the socket drive tool of FIG. 1.
FIG. 3 is a further enlarged, exploded view of the socket drive tool of FIG. 2.

Referring to FIG. 1, a socket wrench 10 includes a ratcheting driver 12, a socket drive tool 14, such as an extension or adaptor, coupled the driver 12 in a known manner, and a socket 16. As discussed below, the socket 16 can be releasably coupled to the socket drive tool 14.

Referring also to FIGS. 2–6, the socket drive tool 14 includes an elongated shaft 18 having a longitudinal axis "A" (FIG. 2) and an exterior surface 19. The shaft 18 includes a drive coupling end 20 having conventional female structure for coupling to mating male structure on the ratcheting driver 12 or other known driver in a known manner. The shaft 18 also has a socket coupling end 22 for coupling to the socket 16, or other like tool.

Disposed at the coupling end 22 is coupling structure 24 for coupling the socket drive tool 14 to the socket 16. As seen in FIGS. 2–5, the coupling structure 24 includes a drive square 26, a recess 28 disposed in the drive square 26 and a detent ball 30 disposed in the recess 28.

Figure 5:
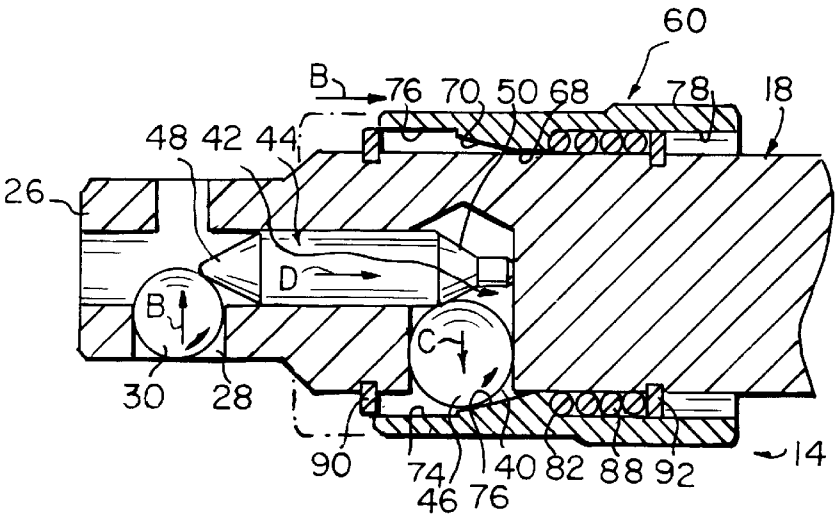
FIG. 5 is a sectional view, similar to FIG. 4, illustrating the coupling structure in a releasing condition.

The drive tool 14 also includes a coupling activator structure 29 for moving the detent ball 30 between a retaining position (FIG. 4) and releasing position (FIG. 5). As seen best in FIGS. 4 and 5, the coupling activator structure 29 includes a cavity 32 disposed in the shaft 18. The cavity 32 has a portion 34 that is substantially coaxial with the axis A of the shaft 18 and in communication with the recess 28. Portion 34 is defined in part by a sidewall 36 and an end wall 38. Cavity 32 also includes a portion 40 which extends radially from portion 34 to the exterior surface 19 of the shaft 18.

As discussed further below, the coupling activator structure 29 also includes a moveable linking structure 42 disposed in the cavity 32. The linking structure 42 includes an elongated rod 44 and a transfer ball 46. The exterior surface of the transfer ball 46 acts, as discussed below, as a cam surface. The elongated rod 44 is disposed in and moveable within cavity portion 34. The elongated rod 44 has a frustoconical-shaped cam surface 48 at one end thereof disposed in engagement with the detent ball 30. The elongated rod 44 also has another frustoconical-shaped cam surface 50 adjacent to the opposite end thereof, and a substantially cylindrical stop portion 52 projecting axially from the frustoconical-shaped cam surface 50. The cam surface 50 is in contact with transfer ball 46.

The coupling activator structure 29 also includes a tubular sleeve 60 disposed about and coaxial with the shaft 18. The sleeve 60 has interior and exterior surfaces 62, 64. The interior surface 62 has a cam surface 66 which includes flat cylindrical surface portion 68 and a sloped, frustoconical surface portion 70, which slopes radially outward from the flat cylindrical surface portion 68 toward an axial end 72 of the sleeve 60. The interior surface 62 also includes a cylindrical surface portion 74 that extends from the sloped frustoconical surface portion 70 to the axial end 72. Since the cylindrical surface portion 74 has a larger diameter than any portion of the sloped frustoconical surface portion 70, an annular radial shoulder 76 is formed therebetween.

The interior surface 62 also has a cylindrical surface portion 78 that extends from the flat cylindrical surface portion 68 to an axial end 80 of the sleeve 60 opposite axial end 72. The cylindrical surface portion 78 has a larger diameter than the flat cylindrical surface portion 68, so that an annular radial shoulder 82 is formed therebetween.

The coupling activator structure 29 has two circumferential grooves 84, 86 disposed in the exterior surface 19 of the shaft 18 (FIGS. 2, 4 and 5) and two locking rings 90, 92 respectively disposed in grooves 84, 86.

The coupling activator structure 29 also includes a helical compression spring 88 disposed about the shaft 18 and within the sleeve 60 between shoulder 82 and locking ring 92.

Figure 4:
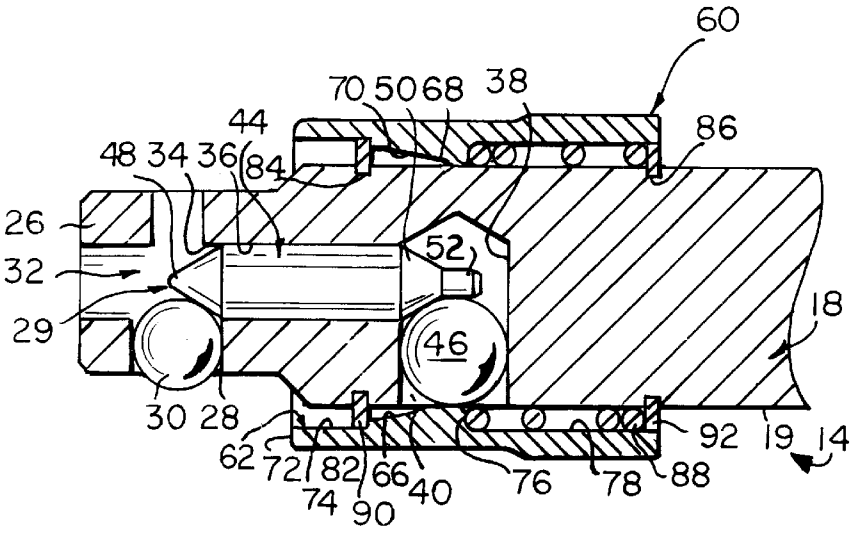
FIG. 4 is a still further enlarged, fragmentary sectional view taken generally along line 4—4 of FIG. 2, illustrating the coupling structure of the socket drive tool in its retaining condition.
Figure 6:
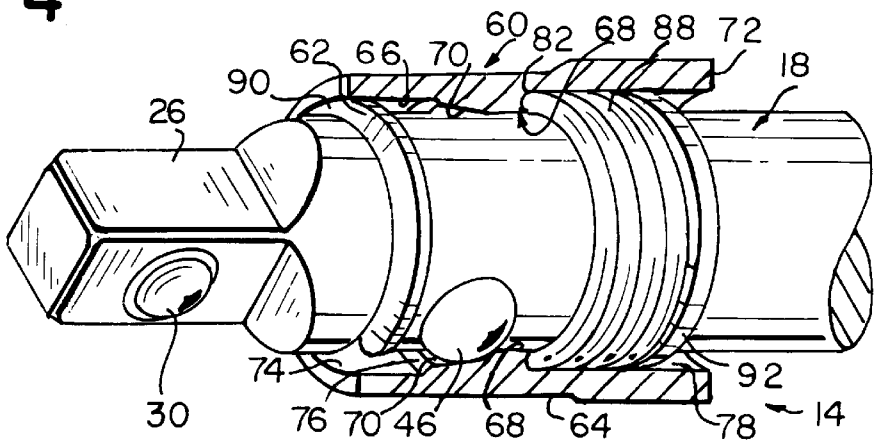
FIG. 6 is a still further enlarged, fragmentary, perspective view, partially broken away, of the coupling structure of the socket drive tool of FIG. 2.

As seen in FIGS. 4 and 5, the sleeve 60 is axially moveable from a retaining condition in FIG. 4 to a releasing condition in FIG. 5. When the sleeve 60 is in its retaining condition, as in FIG. 4, the flat cylindrical surface portion 68 of cam surface 66 is engaged with the transfer ball 46 to drive the transfer ball 46 fully within the portion 40. The transfer ball 46, in turn, by engagement with the frustoconical-shaped cam surface 50 of the elongated rod 44, cams the rod 44 axially outwardly (to the left as viewed in FIG. 4), so that the frustoconical-shaped cam surface 48 of the elongated rod 44 drives the detent ball 30 radially outwardly to its retaining position and prevents the detent ball 30 from moving radially inwardly into the recess 28. This engagement maintains the detent ball 30 in its retaining position (relative to the socket), whereby at least a portion of the detent ball 30 is disposed outside the recess 28 projecting from the exterior surface 19 and in a recess of the socket (not shown) in a known manner to lock the socket to the drive square 26.

To release a socket from the drive tool 14 or to insert a socket onto the drive tool 14, the sleeve 60, as seen in FIG. 5, is moved axially in the direction of arrow B to its releasing condition. This causes the compression spring 88 to be compressed and places the transfer ball 46 in engagement with a portion of the sloped frustoconical surface portion 70 which has a larger diameter than the flat cylindrical surface portion 68. This allows the transfer ball 46 to be moved radially outward in the direction of arrow C, which provides space for the elongated rod 44 to move axially in the direction of arrow D. When the sleeve 60 is in its releasing condition and a radially inward force is applied to the detent ball 30, by a socket or the like, detent ball 30 moves radially inward in the direction of arrow E (to its releasing position) and pushes on the frustoconical-shaped cam surface 48 moving the elongated rod 44 axially in the direction of arrow D until the stop portion 52 contacts the end wall 38. If the transfer ball 46 has not already been moved (by gravity or other means), the frustoconical-shaped cam surface 50 pushes on and moves the transfer ball 46 in the direction of arrow C. When the sleeve 60 is in the releasing condition, a socket can, with little or no force, be placed on or taken off the drive square 26.

When the sleeve 60 is released, the compression spring 88 biases the sleeve 60 back to its retaining condition, shown in FIG. 4. The axial movement of the sleeve 60 is limited in both axial directions. First, retaining ring 90 contacts the shoulder 76 to limit movement in a first axial direction. Second, retaining ring 92 cooperates with shoulder 82 and spring 88 to limit axial movement in the releasing direction where the compression spring 88 is fully compressed, as in FIG. 5.

The drive tool 14 of the present invention is advantageously able to couple to sockets of various manufacturers and prevent the sockets from inadvertently being detached. Different sockets have differently sized and shaped recesses for receiving the detent ball 30. If the socket recess is shallow, detent ball 30 will have to be disposed in the recess 28 in a position that is in between the respective positions it occupies in FIGS. 4 and 5. This will cause the transfer ball 46 to be engaged with a portion of the sloped frustoconical surface portion 70 of the cam surface 66. However, because of the slope angle of the sloped frustoconical surface portion 70 relative to the flat cylindrical surface portion 68, it is believed that a human could not pull such a socket with enough manual force to cause the socket to force detent ball 30 radially inward in the direction of arrow E to cause the elongated rod 44 to push the transfer ball 46 against the flat cylindrical surface portion 68 of the sleeve 60 with enough axial force to overcome the force of compression spring 88 and thereby move the sleeve 60. Preferably, the angle that is formed between the flat cylindrical surface portion 68 and sloped frustoconical surface portion 70 (as measured in a radial plane) is less than about 45°, most preferably about 10°.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A socket drive tool for use with a socket, the drive tool comprising:

an elongated shaft having a coupling structure for coupling to a socket;

the coupling structure including a detent recess and a detent member disposed in the detent recess and moveable between retaining and releasing positions relative to the socket;

the shaft having a cavity therein communicating with the detent recess;

a tubular sleeve disposed about the shaft and having a sleeve cam surface, the tubular sleeve being moveable between a retaining condition and a releasing condition; and a linking structure disposed in and moveable within the cavity and having a first cam surface engageable with the detent member and a second cam surface engageable with the sleeve cam surface, wherein when the tubular sleeve is in the retaining condition, the sleeve cam surface causes the linking structure to hold the detent member in its retaining condition, and wherein when the tubular sleeve is in the releasing condition it causes the linking structure to permit movement of the detent member to its releasing position.

2. The tool of claim 1, wherein the linking structure includes a ball having the second cam surface disposed thereon and an elongated rod having the first cam surface disposed thereon, the rod further including a rod cam surface engageable with the second cam surface.

3. The tool of claim 2, wherein the rod is moveable in the cavity between a rod retaining position and a rod releasing position and the ball is moveable in the cavity between a ball retaining position and a ball releasing position, wherein when the tubular sleeve is in the retaining condition, the tubular sleeve causes the ball to be in the ball retaining position and the rod to be in the rod retaining position.

4. The tool of claim 3, wherein the shaft has an axis, and an exterior surface and the cavity has a first portion substantially coaxial with the axis of the shaft and a second portion radially extending from the first portion to the exterior surface, the rod being disposed in the first portion and at least a portion of the ball being disposed in the second portion.

5. The tool of claim 4, wherein the first rod cam surface is disposed at a first longitudinal end of the rod and has a generally frustoconical shape.

6. The tool of claim 5, wherein the second rod cam surface is disposed at a second longitudinal end of the rod and has a generally frustoconical shape.

7. The tool of claim 6, wherein the first portion of the cavity is defined by a sidewall and an end wall, the rod further including a stop portion axially projecting from the rod cam surface and engageable with the endwall to limit axial movement of the rod in one direction.

8. The tool of claim 1, and further comprising resilient structure to bias the tubular sleeve toward the retaining condition.

9. The tool of claim 8, wherein the resilient structure includes a helical compression spring disposed between the shaft and the tubular sleeve coaxially therewith.

10. The tool of claim 9, wherein the shaft has an exterior surface and first and second grooves disposed in the exterior surface, and further including first and second retaining rings respectively disposed in the first and second grooves, the tubular sleeve having an interior surface and first and second shoulder portions projecting radially inward from the interior surface, the spring being disposed between the first retaining ring and the first shoulder and the second retaining ring being engageable with the second shoulder portion to limit axial movement of the tubular sleeve.

11. The tool of claim 1, wherein the tubular sleeve has an axis substantially coaxial with the shaft, and the sleeve cam surface has a flat first portion and a sloped second portion, the flat portion and the sloped portion defining an angle in a radial plane of less than about 45 degrees.

12. The tool of claim 11, wherein the angle is about 10 degrees.

13. The tool of claim 1, wherein the detent member is a ball.

* * * * *